US006964068B2

(12) United States Patent
Shiraki et al.

(10) Patent No.: US 6,964,068 B2
(45) Date of Patent: Nov. 15, 2005

(54) SANITARY WASHING TOILET SEAT DEVICE

(75) Inventors: Akihito Shiraki, Aichi-ken (JP); Koichi Hayashi, Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/773,156

(22) Filed: Feb. 9, 2004

(65) Prior Publication Data

US 2004/0216223 A1 Nov. 4, 2004

(30) Foreign Application Priority Data

Feb. 20, 2003 (JP) ..... 2003-042887

(51) Int. Cl.[7] ..... E03D 9/08
(52) U.S. Cl. ..... 4/420.4; 4/444
(58) Field of Search ..... 4/420, 420.1–420.5, 4/443, 444, 447, 448

(56) References Cited

U.S. PATENT DOCUMENTS 4,393,525 A * 7/1983 Kondo ..... 4/420.2
5,570,479 A * 11/1996 Chomik et al. ..... 4/420.2
5,839,129 A * 11/1998 Lee ..... 4/448
5,987,660 A * 11/1999 Wang ..... 4/420.4

FOREIGN PATENT DOCUMENTS

JP 10-23995 1/1998

* cited by examiner

*Primary Examiner*—Justine R. Yu
*Assistant Examiner*—Huyen Le
(74) *Attorney, Agent, or Firm*—Oblon, Spivak, McClelland, Maier & Neustadt, P.C.

(57) ABSTRACT

A sanitary washing toilet seat device includes a stationary plate fixed on a rear top side of a toilet bowl and a case accommodating a washing mechanism for spraying warm water form a nozzle. The case is frontwardly movably fitted to the stationary plate by a concave and convex connection in vertical direction.

15 Claims, 5 Drawing Sheets

SANITARY WASHING TOILET SEAT DEVICE

CROSS REFERENCE TO RELATED APPLICATIONS

This application is based on and claims priority under 35 U.S.C. §119 with respect to Japanese Patent Application No. 2003-042887, filed on Feb. 20, 2003, the entire content of which is incorporated herein by reference.

FIELD OF THE INVENTION

The present invention generally relates to a sanitary washing toilet seat device.

BACKGROUND OF THE INVENTION

In general, a conventional or well-known sanitary washing toilet seat device includes a case fixed to a rear top side of a toilet bowl and extending in width direction of the toilet bowl. The case accommodates therein a solenoid valve, a warm water tank for therein reserving an amount of warm water heated up to a set temperature by a heater, and a pair of nozzles. When the solenoid valve is opened, water under pressure is supplied into the warm water tank by way of the resulting solenoid valve, the warm water in the warm water tank is pressurized, pushed out, and supplied to one of the nozzles or a selected nozzle. The resulting warm water under pressure causes the selected nozzle to extend into an inner space of the toilet bowl and ceases at a set position to be spouted from the extended nozzle.

In the above-described conventional or well-known sanitary washing toilet seat device as described in, say, Japanese Patent Laid-open Publication No. Hei.10-23995 which was published without examination in 1998, a space or gap is inevitably or unavoidably defined between an outer surface of the rear top side of the toilet bowl and a bottom surface of the case. Therefore, sometimes urine and/or dust may enter such a space. In order to keep the toilet bowl clean at all times, such urine and dust should be wiped after establishment of opened condition of the top side of the toilet bowl. For bringing the top side of the toilet bowl into the opened condition, the case is connected, by a hinge mechanism, to the toilet bowl to rotate or tilt relative to the toilet bowl.

However, in the conventional sanitary washing toilet seat device the case is connected to the toilet bowl by the hinge mechanism to rotate or tilt relative to the toilet bowl, and a considerable weight or force can be exerted from the case on the hinge mechanism. Therefore, if a hinge pin or pivot pin, which constitutes one of the important components of the hinge mechanism, is made of resin, the hinge pin can be subject to breakage.

In addition, the case generally accommodates a warm water tank, such that whenever the case is tilted through an angle relative to the toilet the hot water tank is inclined to the same extent, which causes a fear of water leakage from the warm water tank. In order to prevent such leakage, it is necessary to drain the warm water from the warm water tank before the case is tilted.

A need thus exists for providing an improved sanitary washing toilet seat which is free from the above-described drawbacks.

SUMMARY OF THE INVENTION

According to a first aspect of the present invention, a sanitary washing toilet seat device is provided having a stationary plate fixed on a rear top side of a toilet bowl; and a case accommodating a washing mechanism for spraying warm water from a nozzle, with the case being mounted onto the plate in male-and-female connection manner so as to be movable in a frontward direction of the toilet bowl.

According to a second aspect of the present invention, a sanitary washing toilet seat device is provided having a stationary plate fixed on a rear top side of a toilet bowl and a case accommodating a washing mechanism for spraying warm water from a nozzle, with the case being detachably connected to the stationary plate.

According to a third aspect of the present invention, a sanitary washing toilet seat device is provided whose gist is to modify the structure of the first aspect such that the male-and-female connection is established by a projection and a hole receiving the projection, with the projection being formed on a bottom surface of the case, and with the hole being formed in the stationary plate.

According to a fourth aspect of the present invention, a sanitary washing toilet seat device is provided whose gist is to modify the structure of the first aspect such that the male-and-female connection is established by a convex portion and a concave portion receiving the convex portion, the convex portion being formed on a bottom surface of the case, the concave portion being formed in the stationary.

According to a fifth aspect of the present invention, a sanitary washing toilet seat device is provided whose gist is to modify the structure of the fourth aspect such that a front side of the concave portion of the stationary plate is expanded in its open area in the upward direction and a front side of the convex portion of the bottom surface of the case is inclined relative to a rear side of the toilet bowl.

According to a sixth aspect of the present invention, a stationary washing toilet seat device is provided whose gist is to modify the structure of the first aspect such that the male-and-female connection is inclined in frontward direction of the toile bowl.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

Figure 1:
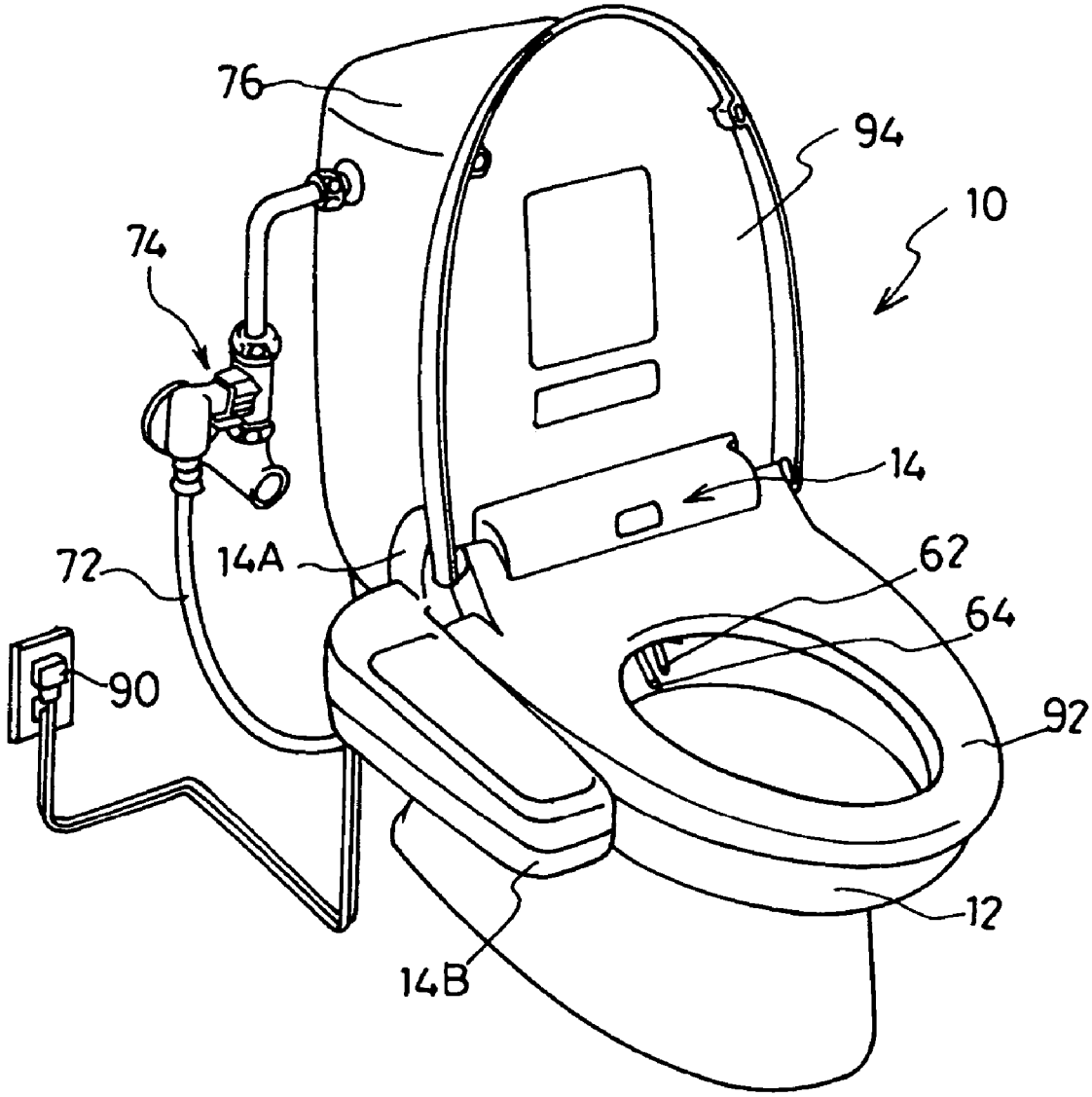
FIG. 1 is a perspective view illustrating a sanitary washing toilet seat device according to an embodiment of the present invention.
Figure 2:
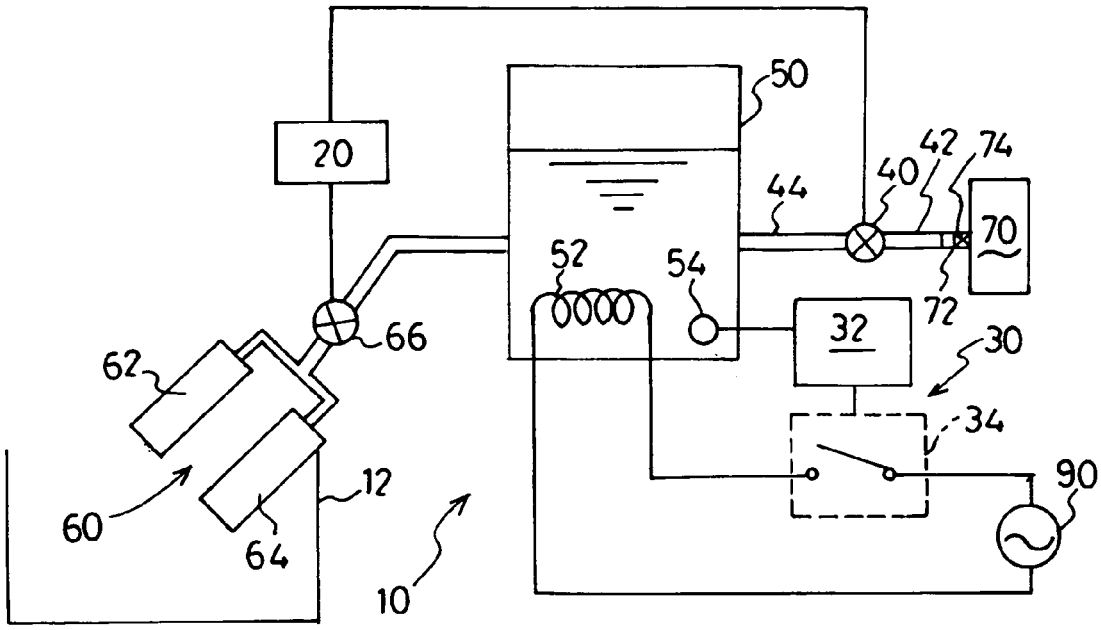
FIG. 2 is a block diagram illustrating a control mechanism for the sanitary washing toilet seat device of FIG. 1.
Figure 3:
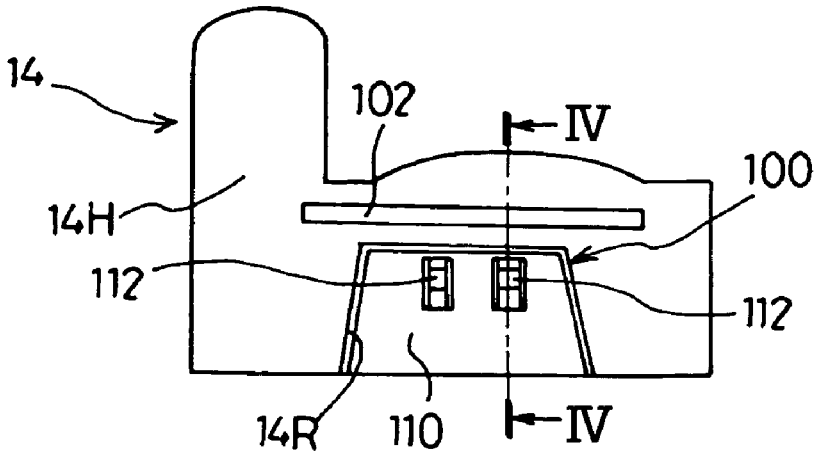
FIG. 3 is a plane view explaining a positional relationship between a bottom surface of a case and a stationary plate when the case is placed in a rear top side of the toilet bowl for the sanitary washing toilet seat device of FIG. 1.
Figure 4:
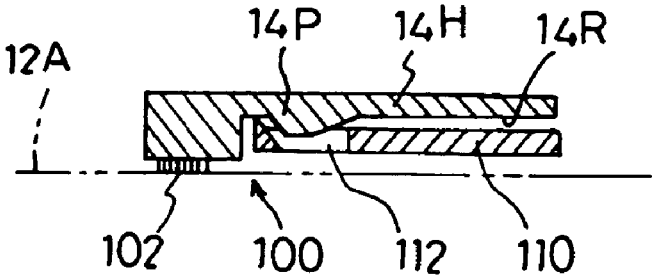
FIG. 4 is an expanded cross sectional view taken along a line IV—IV in FIG. 3.

An embodiment of a sanitary washing toilet seat device according to the present invention will be explained with reference to FIG. 1 through FIG. 7.

A sanitary washing toilet seat device 10 includes a case 14. The case 14 has a main body portion 14A and a sleeve portion 14B. The main body portion 14A is mounted, by way of a sliding mechanism 100 (cf. FIGS. 3 through 7) which will be detailed later, on a rear top side surface 12A of a toilet bowl 12. The sleeve portion 14B of the case 14 is provided therein with a first control mechanism 20. The main body portion 14A of the case 14 is provided therein with a second control mechanism 30, a solenoid valve 40, a warm water tank 50 for reserving therein an amount of warm water heated up to a predetermined., temperature by a heater 52 and a nozzle mechanism 60.

The solenoid valve 40 provided at one side in the main body portion 14A of the case 14 is connected to a water supply source 70 and the warm water tank 50 via a hose 72 and a hose 44, respectively. When the solenoid valve 40 is opened by operation or order of the first control mechanism 20, the warm water in the warm water tank 50 is alternatively supplied to a nozzle 62 for washing an anus and a nozzle 64 for washing a human private portion or female's intimate portion by switching of a switching valve 66. Then, the nozzle 62 for washing the anus or the nozzle 64 for washing the human private portion is extended into an inner space of the toilet bowl 12 and the warm water is sprayed or spouted out from the nozzle 62 for washing the anus or the nozzle 64 for washing the human private portion. Warm water is supplied to either nozzle 62 or the nozzle 64 according to the operation position of the switching valve 66.

The warm water tank 50 is placed at the other side in the main body portion 14A of the case 14. The water in the warm water tank 50 is heated up to a predetermined temperature by the heater 52. The water temperature is constantly detected by a temperature sensor 54 and the detected temperature as a signal is sent to a CPU 32 of the second control mechanism 30. When the water temperature reaches the predetermined value, the CPU 32 orders a TRIAC 34 to establish an intermittent electrical connection of a power source 90 to the heater 52 for continually maintaining the water temperature at the predetermined value.

Figure 5:
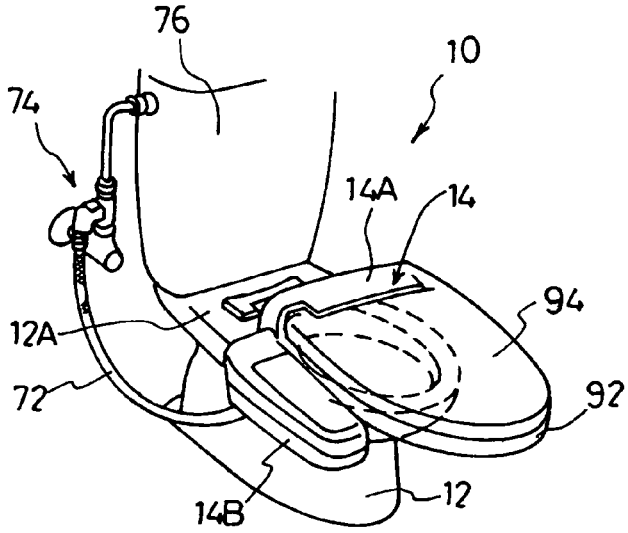
FIG. 5 is a perspective view illustrating a condition of the case moved in the frontward direction of the toilet bowl along with a toilet seat and a toilet cover for the sanitary washing toilet device of FIG. 1.
Figure 6:
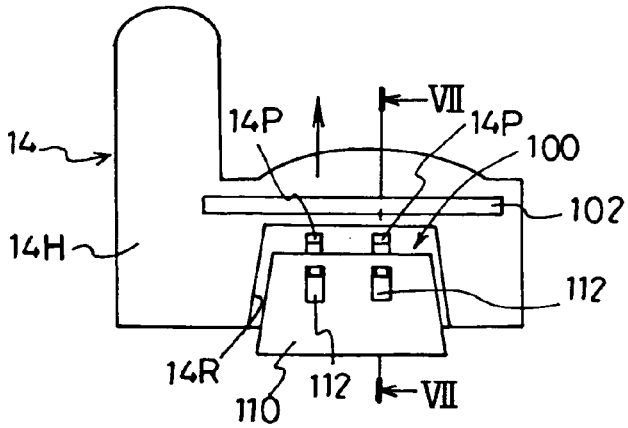
FIG. 6 is a plane view explaining a positional relationship between a bottom surface of a case and a stationary plate when the case is places in a rear top side of the toilet bowl for the sanitary washing toilet device of FIG. 5.

As described above, the main body portion 14A of the case 14 is mounted on the rear top side 12A of the toilet bowl 12 via the slide mechanism 100. In FIG. 1, the case 14, the toilet seat 92 and the toilet cover 94 are moved unitary or in one unit in a frontward direction by sliding the case 14 in the frontward direction (front side in FIG. 1), which makes it possible, as shown in FIG. 5, to open or expose the rear top side 12A of the toilet bowl 12. Therefore, the resulting rear top side 12A of the toilet bowl 12 is more easily ready for being cleaned/wiped.

Figure 7:
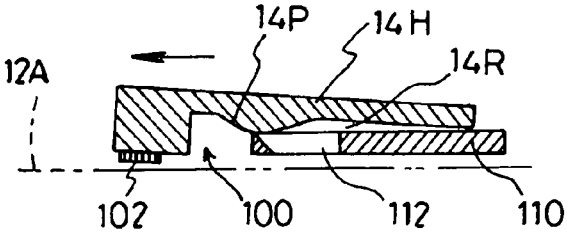
FIG. 7 is an expanded cross sectional view taken along a line VII—VII in FIG. 6.

Hereinafter, the slide mechanism 100 will be described in detail with reference to FIG. 3, FIG. 4, FIG. 6 and FIG. 7. A rubber member 102 is fixed on a bottom surface 14H of the case 14 to extend in width direction of the toilet bowl 12. A top surface of the rubber member 102 is in elastic contact with the rear top side 12A of the toilet bowl 12, which makes it possible to minimize or prevent entrance of urine and dust into a space, which is unavoidably formed or defined between the bottom surface 14H of the case 14 and the rear top side 12A of the toilet bowl 12. A concave portion 14R, which is open in the rearward direction, is formed in the bottom surface 14H of the case 14. The concave portion 14R receives a stationary plate 110 fixed on the rear top side 12A of the toilet bowl 12. A pair of holes 112 and 112 are formed at the stationary plate 110. A pair of projections 14P and 14P which are mounted on the bottom surface 14H of the case 14 fit, from the top, into the pair of the of holes 112 and 112, respectively. The front (upper side in FIG. 3 and left side in FIG. 4) inner surface of the each of the holes 112 of the stationary plate 110 expands to open in the upward direction, while the front (upper side in FIG. 3 and left side in FIG. 4) outer surface of each of the projections 14P and 14P of the bottom surface 14H of the case 14 is inclined toward the rear side of the toilet bowl 12. In brief, such a male-female connection or fitting is in the form a taper-to-taper relationship in the toilet bowl frontward direction. Therefore, when the case 14 is pulled in order to move the case 14 in the frontward direction of the toilet bowl 12, as best shown in FIG. 7, the male-and-female fitting between each of the projections 14P of the bottom surface 14H of the case 14 and the corresponding hole 112 of the stationary plate 110 is easily released.

Therefore, the bottom surface 14H of the case 14 is frontwardly movably fitted to the stationary plate 110 by the concave and convex connections in vertical direction so that the rear top side 12A of the toilet bowl 12 can be opened and cleaned easily without having to tilt the case 14 relative to the toilet bowl 12. When the bottom surface 14H of the case 14 is frontwardly movably fitted to the stationary plate 110 by the concave and convex connections in vertical direction, and the connections are inclined in the frontward direction of the toilet bowl 12 so that the case 14 can be smoothly moved in the frontward direction of the toilet bowl 12.

Figure 8:
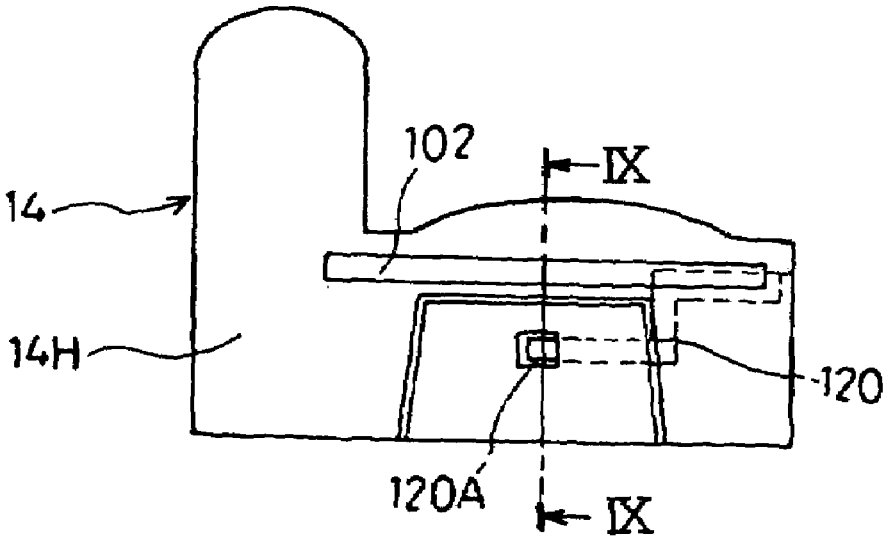
FIG. 8 is a plane view explaining another relationship between the bottom surface of the case and the stationary plate when the case is places in the rear top side of the toilet bowl for the sanitary washing toilet device of FIG. 1.
Figure 9:
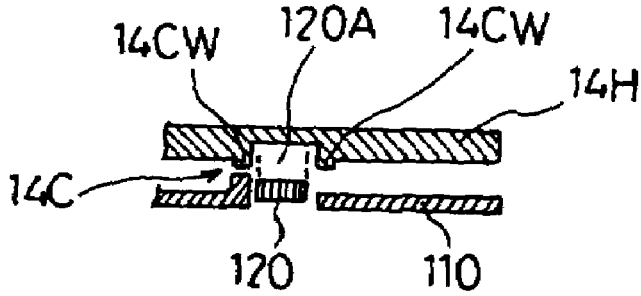
FIG. 9 is an expanded cross sectional view taken along a line IX—IX in FIG. 8.

As shown in FIG. 8 and FIG. 9, a tip portion 120A of a lever 120 extends through a hole 110H of the stationary plate 110 into a boss portion 14C of the bottom surface 14H of the case 14. The boss portion 14C includes a pair of walls which are disposed in front and rear direction (vertical direction in FIG. 8 and horizontal direction in FIG. 9) relative to the toilet bowl. In the above condition, the tip portion 120A of the lever 120 is positioned between a pair of walls 14CW and 14CW. Therefore the bottom surface 14H of the case 14 cannot be moved in the frontward direction of the toilet bowl 12 apart from the stationary plate 110. On the other hand, if the lever 120 is moved to the right under the condition of FIG. 8, and the tip portion 120A of the lever 120 is pulled out between the pair of walls 14CW and 14CW, and the bottom surface 14H of the case 14 can be moved in the frontward direction of the toilet bowl i2 apart from the stationary plate 110.

The principles, a preferred embodiment and mode of operation of the present invention have been described in the foregoing specification and drawings. However, the invention which is intended to be protected is not to be construed as limited to the particular embodiment disclosed. Further, the embodiments described herein are to be regarded as illustrative rather than restrictive. Plural objectives are achieved by the present invention, and yet there is usefulness in the present invention as far as one of the objectives are achieved. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sanitary washing toilet seat device comprising:

a stationary plate for attachment to a rear top surface of a toilet bowl; and a case accommodating a washing mechanism for spraying warm water from a nozzle, wherein the case is mounted onto the plate with a male-and-female connection such that the case is movable in a direction toward a front of the toilet bowl, wherein said male-and-female connection is underneath a bottom of said case such that said male-and-female connection is concealed at least when said toilet seat device is in a retracted position; and wherein the male-and-female connection is established by a projection and a hole receiving the projection, wherein the projection extends downwardly from a bottom surface of the case, and wherein the hole is formed in the stationary plate.

2. A sanitary washing toilet seat device as set forth in claim 1, wherein the male-and-female connection is established by a convex portion and a concave portion receiving the convex portion, wherein the convex portion is formed on a bottom surface of the case and the concave portion is formed in the stationary plate.

3. A sanitary washing toilet seat device as set forth in claim 2, wherein a front side of the concave portion of the stationary plate has an open area which increases in an upward direction, and wherein a front side of the convex portion of the bottom surface of the case is inclined relative to a rear side of the toilet bowl.

4. A stationary toilet seat device as set forth in claim 1, wherein the male-and-female connection is inclined in a frontward direction of the toilet bowl.

5. A device as recited in claim 1, wherein said case is movable between a rearward position and a frontward position, and wherein in said frontward position said projection is outside of said hole.

6. A device as recited in claim 5, wherein a locking device is provided such that said case can be selectively locked in said rearward position and unlocked to allow movement to said frontward position.

7. A device as recited in claim 6, wherein the locking device includes a lever which is movable between first and second positions to selectively lock and unlock said case, wherein in said first position said case is locked and in said second position said case is unlocked.

8. A device as recited in claim 5, wherein said projection includes a tapered portion at a front end thereof and said hole includes a tapered portion at a front end thereof to assist movement of said projection out of said hole as said case is moved from said rearward position toward said frontward position.

9. A device according to claim 1, wherein said case is movable between a rearward position and a frontward position, and wherein at least one of said projection and said hole includes a tapered portion at a front end thereof which is adjacent to a front end of the other of said projection and said hole when said case is in said rearward position, and wherein said projection is moved out of said hole as said case is moved from said rearward position to said frontward position, and wherein said tapered portion assists movement of said projection out of said hole as said case is slid along said stationary plate during movement from said rearward position toward said frontward position.

10. A device according to claim 9, wherein each of said projection and said hole includes a tapered portion at a front end thereof.

11. A device as recited in claim 1, wherein said case is movable between a rearward position and a frontward position, and wherein the device includes a locking device to selectively lock and unlock said case in said rearward position.

12. A device according to claim 11, wherein said locking device includes a lever movable between a first position in which said case is locked in said rearward position, and a second position in which said case is unlocked to allow movement toward said frontward position.

13. A sanitary washing toilet seat device comprising:

a stationary plate for attachment to a rear top surface of a toilet bowl; and a case accommodating a washing mechanism for spraying warm water from a nozzle;

wherein the case is detachably coupled to the stationary plate with a male-and-female connection and wherein the case can be detached from coupling with the stationary plate and slid with a non-pivoting movement toward a front of the toilet bowl; and wherein the male-and-female connection is established by a projection and a hole receiving projection, wherein the projection extends downwardly from a bottom surface of the case, and wherein the hole is formed in the stationary plate.

14. A device as recited in claim 13, wherein said case is movable between a rearward position and a frontward position, and wherein the device includes a locking device to selectively lock and unlock said case in said rearward position.

15. A device according to claim 14, wherein said locking device includes a lever movable between a first position in which said case is locked in said rearward position and a second position in which said case is unlocked to allow movement toward said frontward position.

* * * * *